US006726346B2

(12) United States Patent
Shoji

(10) Patent No.: US 6,726,346 B2
(45) Date of Patent: Apr. 27, 2004

(54) HEADLIGHT

(75) Inventor: Masao Shoji, Osaka (JP)

(73) Assignee: Cateye Co., Ltd., Osaka (JP)

( * ) Notice: Subject to any disclaimer, the term of this patent is extended or adjusted under 35 U.S.C. 154(b) by 0 days.

(21) Appl. No.: 09/909,689

(22) Filed: Jul. 20, 2001

(65) Prior Publication Data

US 2002/0030995 A1 Mar. 14, 2002

(30) Foreign Application Priority Data

Aug. 7, 2000 (JP) ..... 2000-238209

(51) Int. Cl.[7] ..... F21V 7/00

(52) U.S. Cl. ..... 362/328; 362/329; 362/522; 362/332; 362/333; 362/343

(58) Field of Search ..... 362/522, 328, 362/332, 334, 333, 335, 307, 308, 329, 343

(56) References Cited

U.S. PATENT DOCUMENTS

| | | | | |
|---|---|---|---|---|
| 4,373,178 A | * | 2/1983 | Gulliksen | 362/280 |
| 6,007,223 A | * | 12/1999 | Futami | 362/517 |

FOREIGN PATENT DOCUMENTS

| | | | |
|---|---|---|---|
| DE | 3834023 | * 10/1988 | 362/522 |
| DE | 38 34 023 | 4/1990 | |
| EP | 0 354 961 | 2/1990 | |
| FR | A-2614247 | 10/1988 | |
| GB | 531185 | 12/1940 | |
| GB | 611032 | 10/1948 | |
| JP | 1-120702 | 5/1989 | |
| JP | 2-31003 | 2/1990 | |
| JP | 8-268154 | 10/1990 | |
| JP | 8-329703 | 12/1996 | |
| JP | 10-50108 | 2/1998 | |
| JP | P2000-48608 A | 2/2000 | |

OTHER PUBLICATIONS

Patent Abstract of Japan, Publication No. 2000048608, Date of Publication Feb. 18, 2000, "Lense for Vehicle Lamp", Application No. 10230169, date of filing Jul. 30, 1998, Applicant Nippon Zeon Co Ltd, Inventor(s): Mauyama Junko and Obara Teiji.

Patent Abstract of Japan, Publication No. 10050108A, Date of Publication Feb. 20, 1998, "Marking Light for Vehicle", Application No. 09131627, Date of Filing May 7, 1997, Applicant Koito Mfg Co Ltd, Inventor: Natsume Kazunori.

Patent Abstract of Japan, Publication No. 01–120702, Date of Publication May 12, 1989, "Vehicle Head Lamp", Application No. 62–278195, Date of Filing Nov. 5, 1987, Applicant Koito Mfg Co Ltd, Inventor: Nino Naoaki.

Patent Abstract of Japan, Publication No. 08329703A, Date of Publication Dec. 13, 1996, "Head Lamp", Application No. 07138089, Date of Filing Jun. 5, 1995, Applicant Ichikoh Ind Ltd, Inventor: Yanami Ikuomi.

Partial English Translation of Japanese Utility Model Laying–Open No. 2–31003, Date of Laying–Open: Feb. 27, 1990, "Light for a Vehicle", Utility Model Appln. No. 63–108230, Filing Date: Aug. 19, 1998, Applicant: Ichikoh Ind., Ltd., Inventor: Toshinori Suzuki.

Patent Abstract of Japan, Publication No. 08268154A, Date of Publication Oct. 15, 1996, "Lighting Fixture for Vehicle", Application No. 07069448, Date of Filing Mar. 28, 1995, Applicant Toyota Motor Corp., Inventor(s) Okabe Shin and Hidaka Tatsuro.

* cited by examiner

*Primary Examiner*—Thomas M. Sember
*Assistant Examiner*—Anabel Ton
(74) *Attorney, Agent, or Firm*—Olson & Hierl, Ltd.

(57) ABSTRACT

A headlight reduced in size and ensuring sufficiently high efficiency is provided. The headlight includes a light source, a cylindrical condenser lens surrounding the light source from its periphery to transmit light incident from the light source, and a reflector surrounding the light source and the cylindrical condenser lens from their backsides to reflect the light transmitted through the cylindrical condenser lens frontward.

10 Claims, 6 Drawing Sheets

HEADLIGHT

BACKGROUND OF THE INVENTION

1. Field of the Invention

The present invention relates to headlights, and more particularly to a headlight reduced in size while maintaining high efficiency.

2. Description of the Background Art

Conventional headlights have been configured as follows.

(a) Light emitted from a filament placed near the focal point of a parabolic mirror is reflected by the parabolic mirror to form a collimated beam. A front lens adjusts the collimated beam to attain a desired luminous intensity (or light) distribution pattern.

(b) Light emitted from a filament is received at a multi-surface mirror, which reflects the light frontward in a desired light distribution pattern. A front lens simply serves as a cover. Each portion of the multi-surface mirror has a size and angular arrangement determined to reflect the light incident from the filament in a predetermined direction such that the desired light distribution pattern is attained in their entirety.

One of the most critical issues regarding the headlight is its efficiency. In particular, in the case where a battery or the like is used as a power supply, high efficiency is pursued for a longer available time. Herein, the efficiency of the headlight is expressed as a ratio of luminous flux that has reached a target location with respect to the entire luminous flux radiated from a light bulb. In other words, the light that has arrived at locations other than the target location due to disturbance of distribution of the light, for example, is regarded as wasted light noncontributory to the efficiency.

A major stumbling block to downsizing of the headlight is degradation of the efficiency due to increased disturbance of light distribution. When the width and depth of the headlight are determined, the size of a reflector to be incorporated therein is determined. A filament is disposed near the focal point of the reflector. When the reflector is downsized and the focal distance is shortened, light emitted from portions of the filament off the focal point of the reflector may not be reflected as desired, thereby deteriorating the efficiency. More specifically, when the reflector is downsized, even if a filament of the same size is utilized, the degree of deviation of the portions of the filament off the focal point of the reflector increases, so that the disturbance of the light distribution is amplified correspondingly.

Such increase in disturbance of the light distribution due to the downsizing could be alleviated using a multi-surface mirror. However, the efficiency of the downsized headlight cannot be improved to a satisfactory level even if the multi-surface mirror is utilized. Accordingly, there has been a demand for development of a headlight reduced in size with the high efficiency being maintained.

SUMMARY OF THE INVENTION

An object of the present invention is to provide a downsized headlight with sufficiently high efficiency.

According to the present invention, a headlight projecting light frontward includes: a light source; a cylindrical condenser lens that surrounds the light source from its periphery and transmits light incident from the light source; and a reflector that surrounds the light source and the cylindrical condenser lens from their backsides and reflects the light transmitted through the cylindrical condenser lens frontward.

The cylindrical condenser lens is arranged to prevent divergence of the light emitted from the light source. Specifically, the light radiated from the light source sideward is received at the cylindrical condenser lens and is restricted in the degree of divergence before being directed to the reflector. Accordingly, when luminous flux of the same quantity is being emitted from the light source sideward, with provision of the cylindrical condenser lens, it becomes possible to reduce the height of the reflector in its axial direction, and hence to reduce the diameter thereof at its front end. More specifically, to reflect luminous flux of the same quantity without provision of the cylindrical condenser lens, a reflector would be required which covers an area up to a crossing point with an extended line of the line connecting the light source and a position where the front end of the cylindrical condenser lens is supposed to be located. Herein, this extended line is called a "downsizing reference line". With the provision of the cylindrical condenser lens, the reflector is only required to cover the back of the light source and the condenser lens up to the front end of the condenser lens. The light restricted in divergence is thus reflected frontward.

As a result, it is possible to considerably reduce the size of the reflector without degrading the efficiency. Here, the light source may be any kinds of illuminators, including a light bulb having a filament, a light-emitting diode and others.

Preferably, the cylindrical condenser lens of the headlight of the present invention is a cylindrical convex lens.

Arrangement of the cylindrical convex lens makes it possible to turn the light emitted from the light source into a light beam restricted in the degree of divergence.

Still preferably, the cylindrical convex lens concentrates the incident light as a parallel beam.

If the light restricted in divergence forms the parallel beam, it becomes easier to design the surface of the reflector reflecting the light frontward. This allows downsizing and also facilitates designing of the light distribution pattern with the reflector. Such a parallel beam can be obtained from the light transmitted through the cylindrical convex lens by positioning the light source at the focal point of the cylindrical convex lens.

Still preferably, the cylindrical convex lens is a Fresnel lens of a cylindrical shape.

Provision of the Fresnel lens allows reduction of the lens thickness. This leads to more compact configuration of the cylindrical convex lens around the light source and of the reflector, contributing to further downsizing of the headlight.

Preferably, the reflector of the headlight of the present invention is a multi-surface mirror.

Using the multi-surface mirror, it is possible to obtain a wide variety of frontward light distribution patterns, from which a predetermined pattern can be selected and set.

Preferably, the headlight of the present invention is provided with a front lens in front of the light source. The front lens preferably includes at least two portions having light transmission characteristics different from each other.

Provision of the portions having different light transmission characteristics enables meticulous designing of the light distribution patterns with the front lens. The light transmission characteristic of each portion of the front lens can be determined by adjusting the thickness, curvatures of both surfaces and refractive index of the relevant portion. With the headlight reduced in size as described above, even if the center lens is small in size, the solid angle at the light source encompassing the center lens becomes large. Accordingly, it is possible to increase influence of the center lens on the light distribution pattern.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
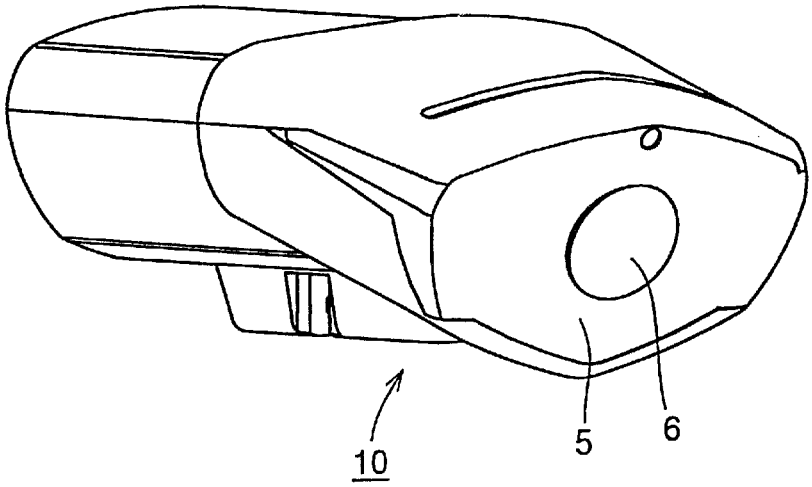
FIG. 1 is a perspective view showing an appearance of the headlight according to an embodiment of the present invention.

Embodiments of the present invention will be described with reference to the drawings. FIG. 1 is a perspective view of the headlight according to an embodiment of the present invention. This headlight 10 is attached to a bicycle and projects light frontward from a front lens 5 including a center lens 6.

Figure 2:
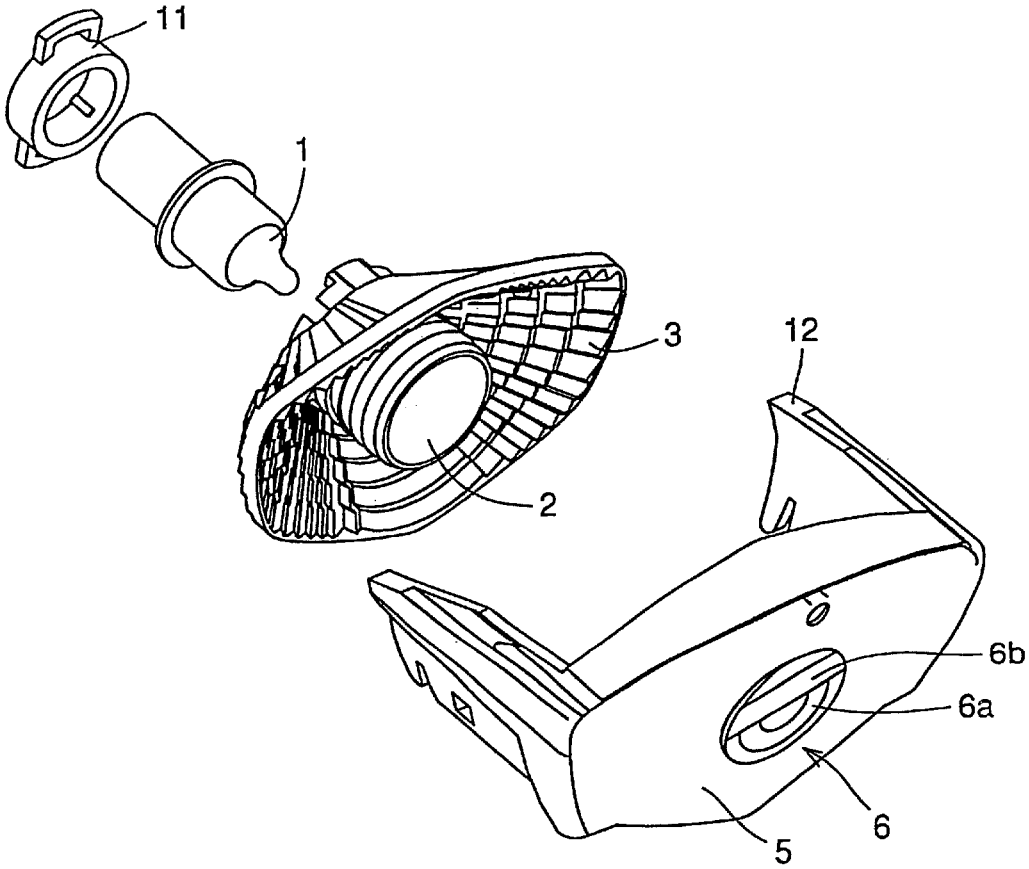
FIG. 2 is an exploded view of portions of the headlight in FIG. 1.

FIG. 2 is an exploded view of portions of the headlight shown in FIG. 1. Front lens 5 including center lens 6 and a connect portion 12 by which the front lens is attached to a housing (not shown) are formed in one piece. Center lens 6 is composed of a bar lens 6*b* and a concentric lens 6*a*.

At the back of the front lens, a multi-surface mirror 3 and a cylindrical convex lens 2 surrounded by the multi-surface mirror are provided. A Fresnel lens is employed as the cylindrical convex lens to achieve a sufficient effect of the convex lens with a thin lens. A light source 1 with a filament (not shown) is inserted into Fresnel lens 2. The light source is supplied with power via a socket 11.

Figure 3:
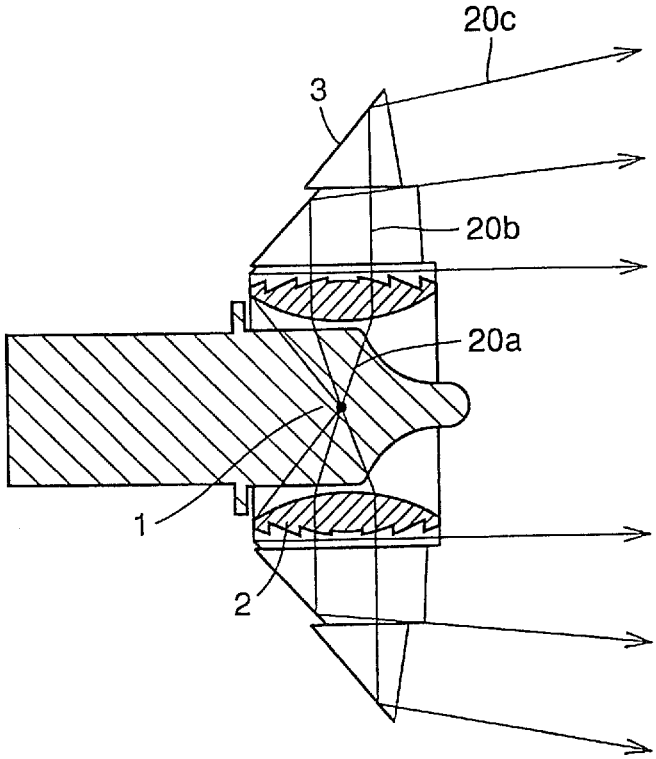
FIG. 3 illustrates light paths of the light emitted from the light source of the headlight according to the embodiment of the present invention.

FIG. 3 is a cross sectional view showing light paths of the light emitted from the light source when the headlight is in operation. The filament has been designed to emit light from a narrow range on a line intersecting the central axis of the cylinder at right angles. This short filament is disposed approximately at the focal point of Fresnel lens 2. As light 20*a* is radiated from the filament located at the focal point of the cylindrical convex lens, it becomes a parallel beam 20*b* after being transmitted through the convex lens. The parallel beam is reflected by multi-surface mirror 3 that is arranged to direct the light frontward with a predetermined angle, and projected frontward as a reflected light 20*c*. In FIG. 3, the light is projected frontward to slightly diverge. Using such a cylindrical convex lens, it is possible to promote downsizing of the headlight while ensuring the high efficiency, without a reflector covering a wide area.

Figure 4:
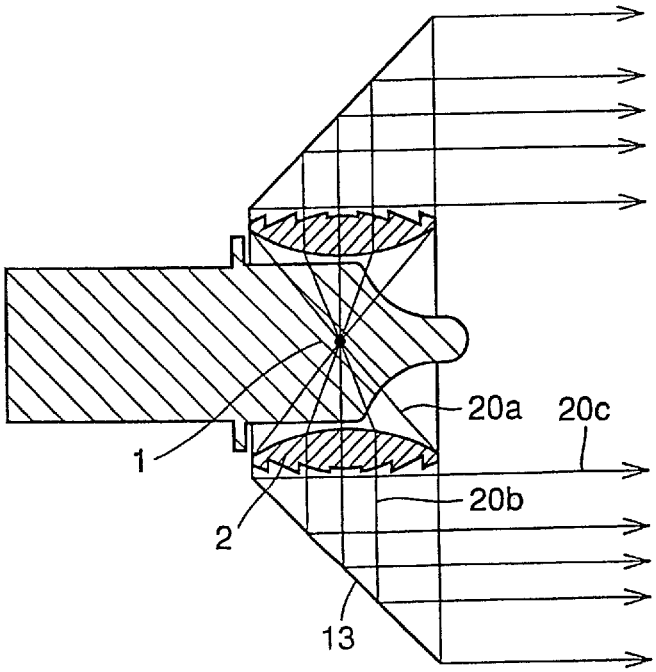
FIG. 4 illustrates light paths of the light emitted from the light source of the headlight according to another embodiment of the present invention wherein a conular reflector is employed.

FIG. 4 shows light paths from the light source in the case where a common cone reflector 13 is used instead of the multi-surface mirror. The light 20*a* radiated from light source 1 sideward is transmitted through cylindrical Fresnel lens 2 and becomes parallel beam 20*b*, which is reflected by cone reflector 13 and projected frontward as parallel beam 20*c*.

Figure 5:
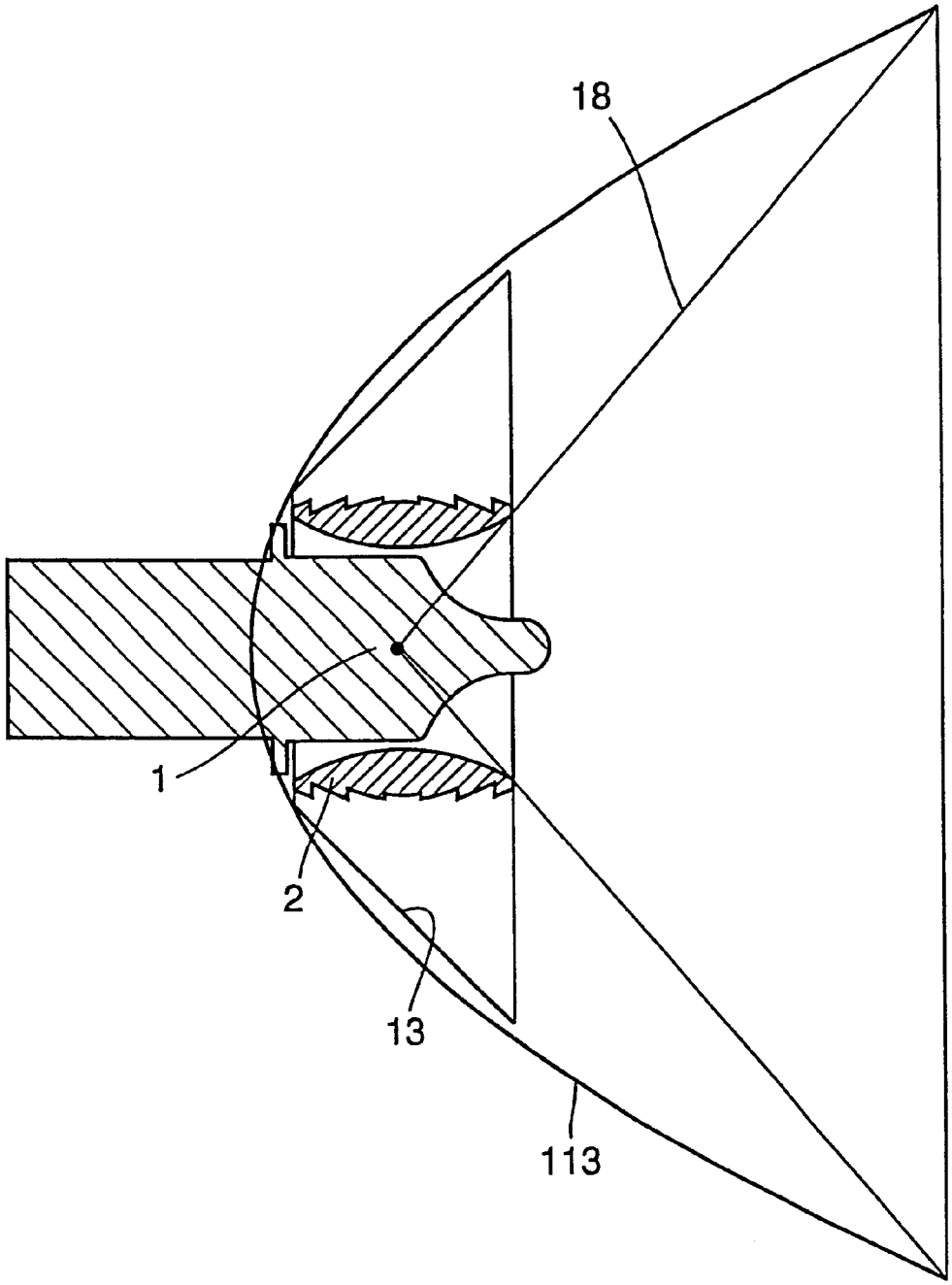
FIG. 5 is a diagram for comparison between the cone reflector of the headlight in FIG. 4 and a reflector of a conventional headlight.

In FIG. 5, reflector 13 of the headlight according to the present invention provided with the cylindrical convex lens is compared in size with a reflector 113 of a conventional headlight unprovided with the cylindrical convex lens. Here, the two headlights are designed to use the respective reflectors to reflect and project frontward the same quantities of luminous flux. In the case of the conventional headlight without the cylindrical convex lens, reflector 113 is required to have a size that covers an area up to a crossing point with downsizing reference line 18 described above, which is an extended line of the line connecting light source 1 and a position where the front end of the cylindrical convex lens is supposed to be located. In the case of the headlight of the present invention, the cylindrical convex lens is used to project the parallel beam restricted in the degree of divergence, so that reflector 13 only needs to cover an area up to the front end of the convex lens. If the restricted degree of divergence is increased, a smaller reflector could be used according to the degree of restriction. With a reflector too small in size, however, it would become necessary to increase the dimensional accuracy of the reflector. Accordingly, the parallel beam is desired as the light restricted in divergence. The parallel beam facilitates designing of the surface of the reflector for forming an intended light distribution pattern.

With the present invention, a reflector having a depth of approximately one third and a width of approximately four sevenths of the conventional reflector can be used to secure the same efficiency. This results in a remarkable downsizing since the volume of the rectangular parallelepiped for containing the reflector is reduced to approximately 10% of the conventional case.

Figure 6:
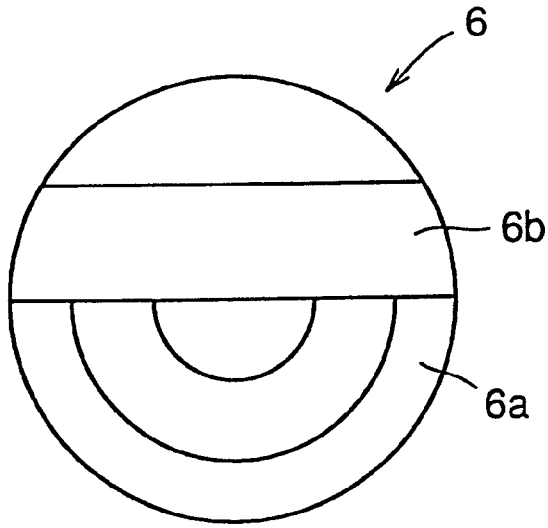
FIG. 6 is a front view of the center lens of the headlight in FIG. 1.
Figure 7:
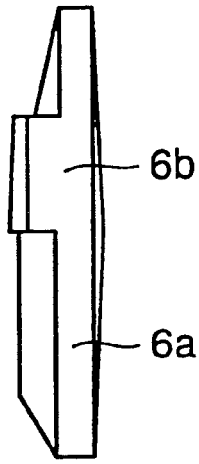
FIG. 7 is a vertical sectional view of the center lens shown in FIG. 6.
Figure 8:
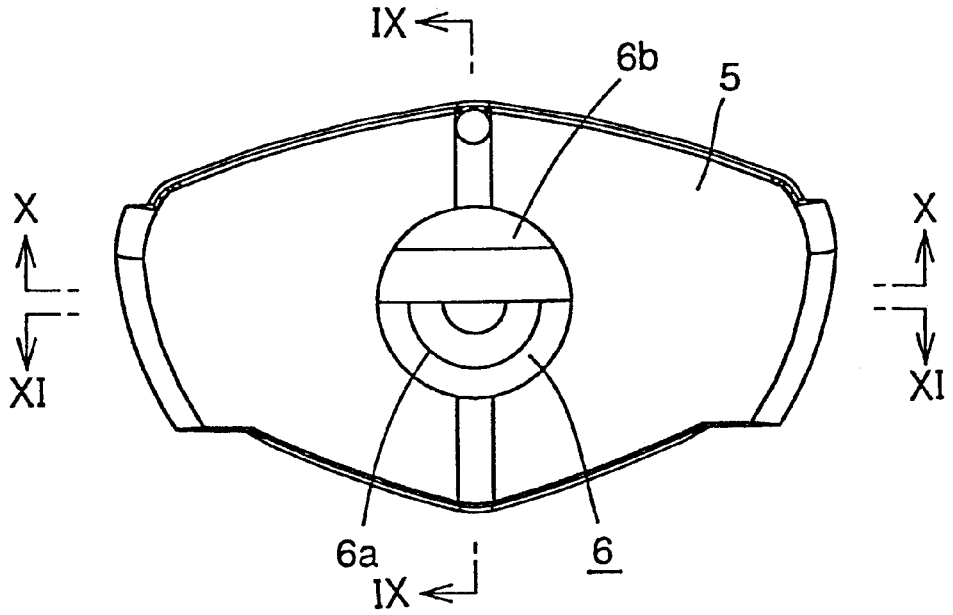
FIG. 8 is a front view of the front lens of the headlight in FIG. 1.

Center lens 6 provided to the front lens is now explained. FIG. 6 is a front view and FIG. 7 is a vertical sectional view of the center lens. Center lens 6 is composed of an upper bar-shaped convex lens 6*b* and a lower concentric Fresnel lens 6*a*. FIG. 8 is a front view of front lens 5 provided with center lens 6.

Figure 9:
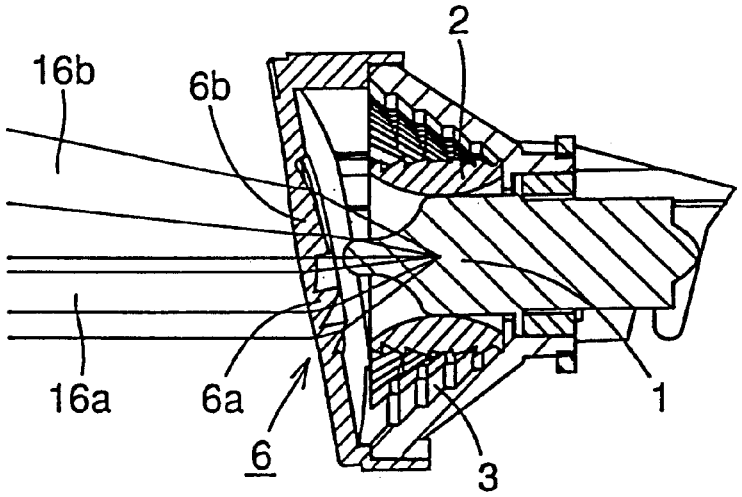
FIG. 9 shows a cross section taken along the line IX—IX in FIG. 8.

FIG. 9 shows a cross section taken along the line IX—IX in FIG. 8. Referring to FIG. 9, light source 1 is placed at the focal point of concentric Fresnel lens 6*a*. As seen from FIG. 9, the light 16*b* transmitted through the upper bar lens of center lens 6 is projected frontward, diverged in an upper direction. The light 16*a* transmitted through the lower portion of center lens 6 is projected frontward as the parallel beam.

Figure 10:
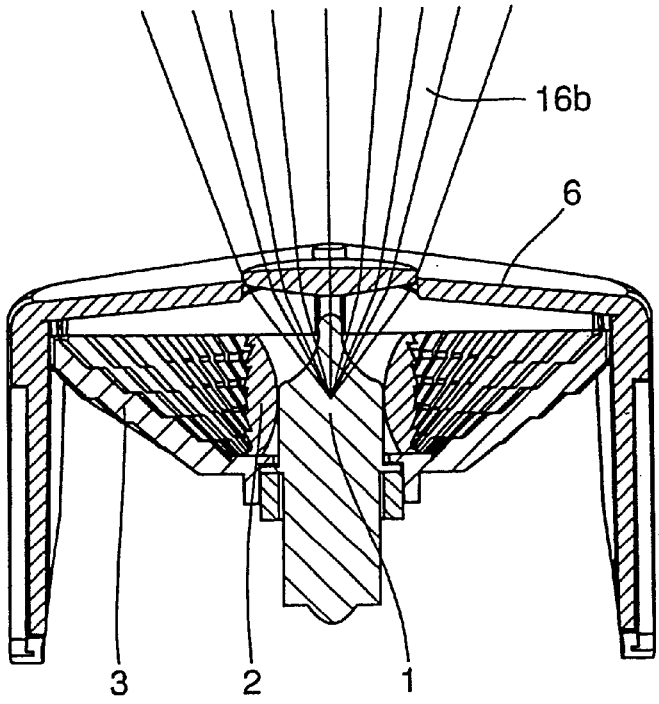
FIG. 10 shows a cross section taken along the line X—X in FIG. 8.
Figure 11:
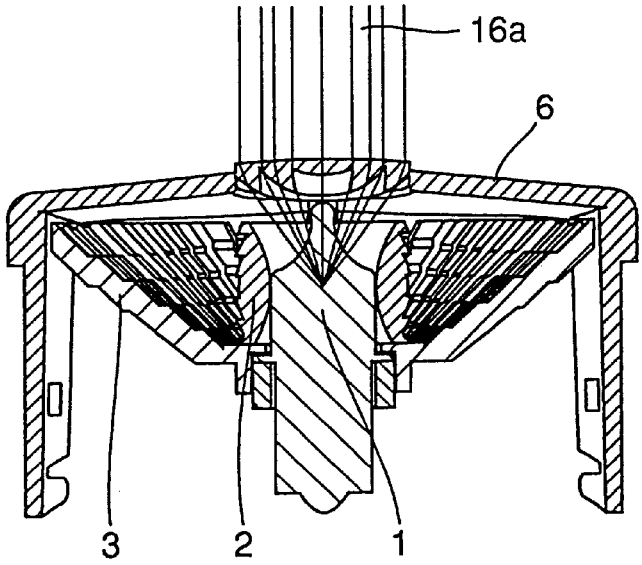
FIG. 11 shows a cross section taken along the line XI—XI in FIG. 8.

FIGS. 10 and 11 show cross sections taken along the lines X—X and XI—XI in FIG. 8, respectively. It is appreciated that light 16*b* transmitted through bar lens 6*b* is again projected frontward with divergence. It is also understood that light 16*a* transmitted through concentric lens 6*a* is again projected frontward as the parallel beam without divergence.

Provision of the center lens having such portions different in light transmission characteristic increases the degree of freedom of feasible light distribution. For example, when riding on the bicycle, it is possible to illuminate frontward only in a narrow range into the distance to alleviate the dazzle suffered by a driver of an oncoming car on the opposite lane.

In the front lens described above, the concentric Fresnel lens and the bar lens may be replaced with each other in vertical relationship according to where on the bicycle the headlight is being attached or according to a light distribution pattern that is being desired.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A headlight projecting light frontward comprising:

a light source;

a cylindrical convex lens surrounding said light source from its periphery to transmit light incident from said light source; and a reflector surrounding said light source and said cylindrical convex lens from their backsides to reflect the light transmitted through said cylindrical convex lens frontward; the reflector having a surface consisting essentially of a non-paraboloid surface that has a shape having no focal point;

said light source being located at the focal point of said cylindrical convex lens, said reflector being a multi-surface mirror.

2. The headlight according to claim 1, further comprising a front lens in front of said light source, the front lens having at least two portions having light transmission characteristics different from each other.

3. The headlight according to claim 1, further comprising a front lens in front of said light source, the front lens having at least two portions having light transmission characteristics different from each other.

4. A headlight projecting light frontward, comprising:

a light source;

a cylindrical condenser lens surrounding said light source from its periphery to transmit light incident from said light source;

a reflector surrounding said light source and said cylindrical condenser lens from their backsides to reflect the light transmitted through said cylindrical condenser lens frontward; and a front lens in front of said light source, the front lens having at least two portions having light transmission characteristics different from each other.

5. A headlight projecting light frontward, comprising:

a light source;

a cylindrical condenser lens surrounding said light source from its periphery to transmit light incident from said light source;

a reflector surrounding said light source and said cylindrical condenser lens from their backsides to reflect the light transmitted trough said cylindrical condenser lens frontward; said reflector being a multi-surface mirror; and a front lens in front of said light source, the front lens having at least two portions having at least two portions having light transmission characteristics different from each other.

6. A headlight projecting light frontward comprising:

a light source;

a cylindrical convex lens surrounding said light source from its periphery to transmit light incident from said light source; and a reflector surrounding said light source and said cylindrical convex lens from their backsides to reflect the light transmitted through said cylindrical convex lens frontward; the reflector having a surface consisting essentially of a non-paraboloid surface that has a shape having no focal point;

said light source being located at the focal point of said cylindrical convex lens, said reflector including a reflector surface consisting essentially of a conical surface.

7. The headlight according to claim 6, wherein said cylindrical convex lens is a Fresnel lens of a cylindrical shape.

8. A headlight projecting light frontward comprising:

a light source;

a cylindrical convex lens surrounding said light source from its periphery to transmit light incident from said light source; and a reflector surrounding said light source and said cylindrical convex lens from their backsides to reflect the light transmitted through said cylindrical convex lens frontward; the reflector having a surface consisting essentially of a non-paraboloid surface that has a shape having no focal point;

said light source being located at the focal point of said cylindrical convex lens, said reflector consisting essentially of a conically shaped multi-surface mirror.

9. The headlight according to claim 8, wherein said cylindrical convex lens is a Fresnel lens of a cylindrical shape.

10. The headlight according to claim 8, further comprising a front lens in front of said light source, the front lens having at least two portions having light transmission characteristics different from each other.

* * * * *